US010285558B2

(12) United States Patent
O'Shea

(10) Patent No.: US 10,285,558 B2
(45) Date of Patent: May 14, 2019

(54) FLOOR CLEANING MOP APPARATUS

(71) Applicant: JSK Imports Limited, Cork (IE)

(72) Inventor: Tadgh O'Shea, Cork (IE)

(73) Assignee: JSK Imports Limited, Cork (IE)

( * ) Notice: Subject to any disclaimer, the term of this patent is extended or adjusted under 35 U.S.C. 154(b) by 213 days.

(21) Appl. No.: 15/272,486

(22) Filed: Sep. 22, 2016

(65) Prior Publication Data

US 2018/0078109 A1 Mar. 22, 2018

(51) Int. Cl.

| | |
|---|---|
| ***B25G 1/04*** | (2006.01) |
| ***B25G 3/38*** | (2006.01) |
| ***A47L 13/44*** | (2006.01) |
| ***A47L 13/256*** | (2006.01) |

(52) U.S. Cl.

CPC ..... *A47L 13/256* (2013.01); *A47L 13/44* (2013.01); *B25G 1/04* (2013.01); *B25G 3/38* (2013.01)

(58) Field of Classification Search

CPC .... A47L 13/256; A47L 13/254; A47L 13/258; A47L 13/44

USPC ..... 15/231

See application file for complete search history.

(56) References Cited

U.S. PATENT DOCUMENTS

| | | | | | |
|---|---|---|---|---|---|
| 3,737,938 | A * | 6/1973 | Saltzstein | A47L 13/256 | 15/231 |
| 3,792,505 | A * | 2/1974 | Saltzstein | A47L 13/256 | 15/147.2 |
| 5,165,138 | A | 11/1992 | Garabedian | | |
| 6,061,864 | A * | 5/2000 | Ensson | A47L 13/254 | 15/144.2 |
| 6,695,516 | B2 * | 2/2004 | DeFields | A47L 13/22 | 401/137 |
| 6,795,995 | B1 * | 9/2004 | Holbus | A46D 1/00 | 15/208 |
| D731,727 | S * | 6/2015 | Clarke | D32/35 | |

FOREIGN PATENT DOCUMENTS

| | | | | |
|---|---|---|---|---|
| CN | 201948957 U | | 8/2011 | |
| CN | 202942059 U | | 5/2013 | |
| DE | 10310320 A1 | | 3/2004 | |
| GB | 201405744 | * | 5/2014 | A47L 13/20 |
| GB | 2524741 A | | 7/2015 | |
| IE | S86587 B2 | | 9/2015 | |
| IE | 20150089 A1 | | 10/2015 | |
| JP | 2007054337 A | | 3/2007 | |

OTHER PUBLICATIONS

Evans, R., Application No. GB1405744.2, Search Report, dated Sep. 26, 2014, 2 pages.

* cited by examiner

*Primary Examiner* — Laura C Guidotti
(74) *Attorney, Agent, or Firm* — LaBatt, LLC

(57) ABSTRACT

A floor cleaning mop apparatus comprises an elongate handle terminating at its lower end in a base plate to which it is attached by a hinged connector. The base plate is releasably engagable in use with an associated double-faced waffle weave floor cleaning cloth. Hook elements on a bottom face of the base plate engage and grab onto a textured pile upper surface of the floor cleaning cloth. A number of spaced-apart engagement portions on the upper surface of the floor cleaning cloth are releasably engagable by the base plate for moving the floor cleaning cloth across a floor surface in use.

17 Claims, 6 Drawing Sheets

FLOOR CLEANING MOP APPARATUS

INTRODUCTION

This invention relates to a floor cleaning mop apparatus and a floor cleaning system incorporating said mop apparatus.

Conventional mops are made from cotton and are designed so that cotton strips hang from the mop head. A typical conventional mopping system comprises this cotton head mop which is used in conjunction with a plastic or tin bucket that has an inbuilt wringer system. However, such conventional mopping systems are not ideal as the cotton fibres in the mop are round and because of this they are not capable of removing, holding and absorbing soils or residue from the floor. The circular nature of the fibre means that they only push the soils around the floor, the moisture on the floor leads the user to believe that the floor has been completely cleaned. However, when the moisture evaporates from the surface of the floor the loosened soils that have not been absorbed by the cotton have simply dried back onto the floor as a thin film. After a number of successive daily cleanings, layers of film build up and this eventually leads to a heavy soil build up on the surface of the floor.

While cotton mops make up the majority of mops, there are also mops which use cellulose sponges, microfiber mop pads and strip mop pads which have the same problems as the cotton mops.

The present invention is directed towards overcoming these problems.

SUMMARY OF THE INVENTION

According to the invention there is provided a floor cleaning mop apparatus comprising: an elongate handle, a base plate mounted at a lower end of the handle, a waffle weave microfiber double-faced floor cleaning cloth, the base plate being releasably engagable with at least two associated spaced-apart engagement portions on an upper surface of the floor cleaning cloth in use for moving the floor cleaning cloth across a floor surface, the floor cleaning cloth having a width greater than the width of the base plate and projecting outwardly at each side of the base plate when the base plate is engaged with one of said engagement portions, the base plate and the floor cleaning cloth being releasably engagable by means of a hook and pile fastener.

In another embodiment of the invention the floor cleaning cloth has four spaced-apart engagement portions.

In another embodiment the base plate has a pair of spaced-apart parallel elongate re-entrant slots on an underside of the base plate, a hook strip being mounted in each slot and having a mat of hook elements which projects outwardly through a mouth of the slot for engagement with the floor cleaning cloth.

In another embodiment each hook strip has a panel carrying the mat of hook elements with a border at each side of the panel outside the mat, said panel being slidably engagable within the slot in the underside of the base plate with said borders engaging behind in-turned lips at a mouth of the slot to retain the panel within the slot.

In another embodiment end pieces are fitted at each end of the base plate to retain the hook strips within the associated slots, each end piece having an end wall which engages the end of the base plate, a tongue extending outwardly from the end wall engaging a top face of the base plate and having a lug which extends through an associated through hole in the base plate and a pair of spaced-apart hook strip retaining flanges extending outwardly from the end wall engaging within the slots on the underside of the base plate within which the hook strips are mounted.

In another embodiment end pieces are fitted to each end of the base plate to retain the hook strips within the associated slots, each end piece having an end wall which engages against an end of the base plate, and a pair of spaced-apart hook strip retaining flanges extending outwardly from the end wall and engaging within the slots on the underside of the base plate within which the hook strips are mounted, each hook strip retaining flange having stepped edges for complementary inter-engagement with a recess and an associated inwardly directed lip at each side of the slot, at least one of said lips being crimped into locking engagement with a stepped edge of the flange.

In another embodiment a third re-entrant slot is provided on an underside of the base plate parallel to and located between the slots within which the hook strips are mounted, and each end piece has a lug mounted between the flanges and projecting outwardly from the end wall for engagement within the third slot, said lug having stepped sides for complementary inter-engagement with a recess and an associated inwardly directed lip at each side of the third slot, at least one of said lips being crimped into locking engagement with a stepped side of the lug.

In one embodiment of the invention the microfiber of the floor cleaning cloth comprises a mixture of polyester and polyamide fibres.

In another embodiment of the invention the microfiber comprises 80% polyester and 20% polyamide fibre.

In a further embodiment of the invention the handle is pivotally connected to the base plate for pivoting about an axis which is parallel to a longitudinal axis of the baseplate.

In another embodiment the handle is connected to the base plate by a hinged connector comprising a pair of spaced-apart pivot mounting blocks on the base plate, said mounting blocks engaged by a hinge element, said hinge element having a U-shaped body having a looped inner end with outwardly extending arms, pivot pins projecting laterally outwardly at outer free ends of the arms to pivotally engage the mounting blocks for pivoting about a first axis, a pivot pin at a lower end of the handle pivotally engaging within the looped inner end for pivoting about a second axis, said first axis and said second axis being mutually perpendicular.

In a still further embodiment of the invention the handle is telescopic.

BRIEF DESCRIPTION OF THE DRAWINGS

The invention will be more clearly understood by the following description of some embodiments thereof, given by way of example only, with reference to the accompanying drawings, in which.

DETAILED DESCRIPTION OF THE PREFERRED EMBODIMENTS

Figure 1:
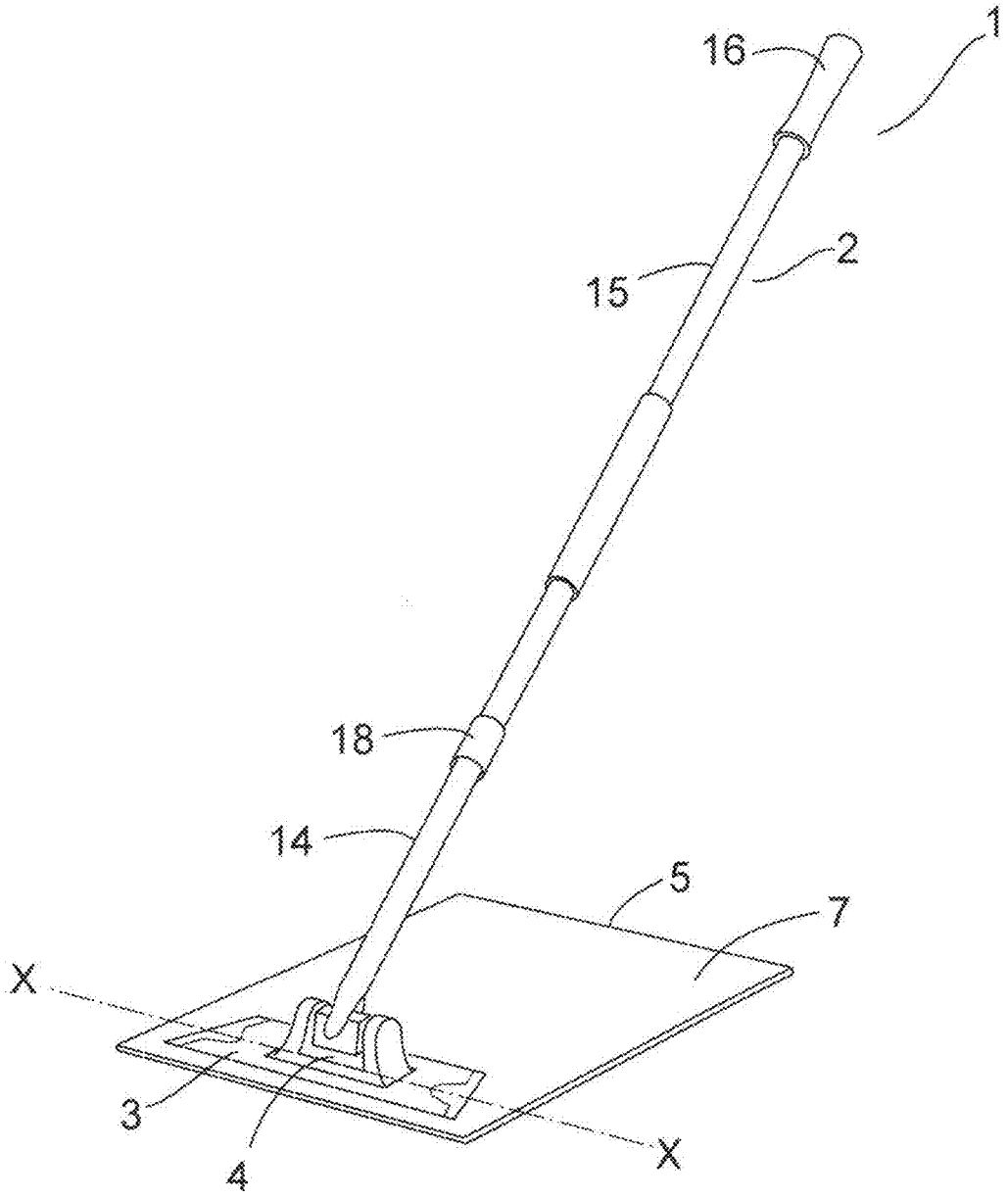
FIG. 1 is a perspective view of a floor cleaning mop apparatus according to the invention.

Referring to the drawings and initially to FIGS. 1 to 10 thereof, there is illustrated a floor cleaning mop apparatus according to the invention indicated generally by the reference numeral 1. The floor cleaning mop apparatus 1 comprises an elongate handle 2 terminating at its lower end in a base plate 3 to which it is attached by a hinged connector 4. The base plate 3 is releasably engagable in use with a double-faced waffle weave floor cleaning cloth 5. At least two, and in this case four, spaced-apart engagement portions 6 on an upper surface 7 of the floor cleaning cloth 5 are releasably engagable by the base plate 3 for moving the floor cleaning cloth 5 across a floor surface in use.

Figure 3:
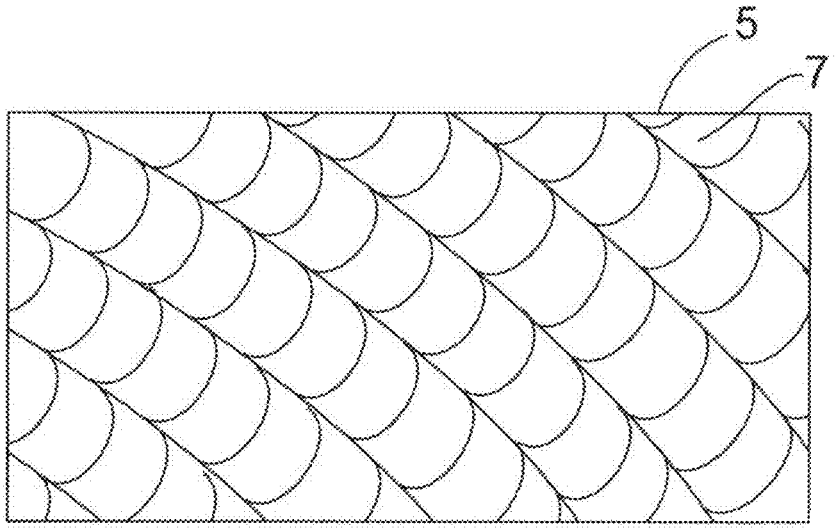
FIG. 3 is an enlarged detail view of portion of the floor cleaning cloth showing a textured surface of the floor cleaning cloth.
Figures 4, 5, 6:
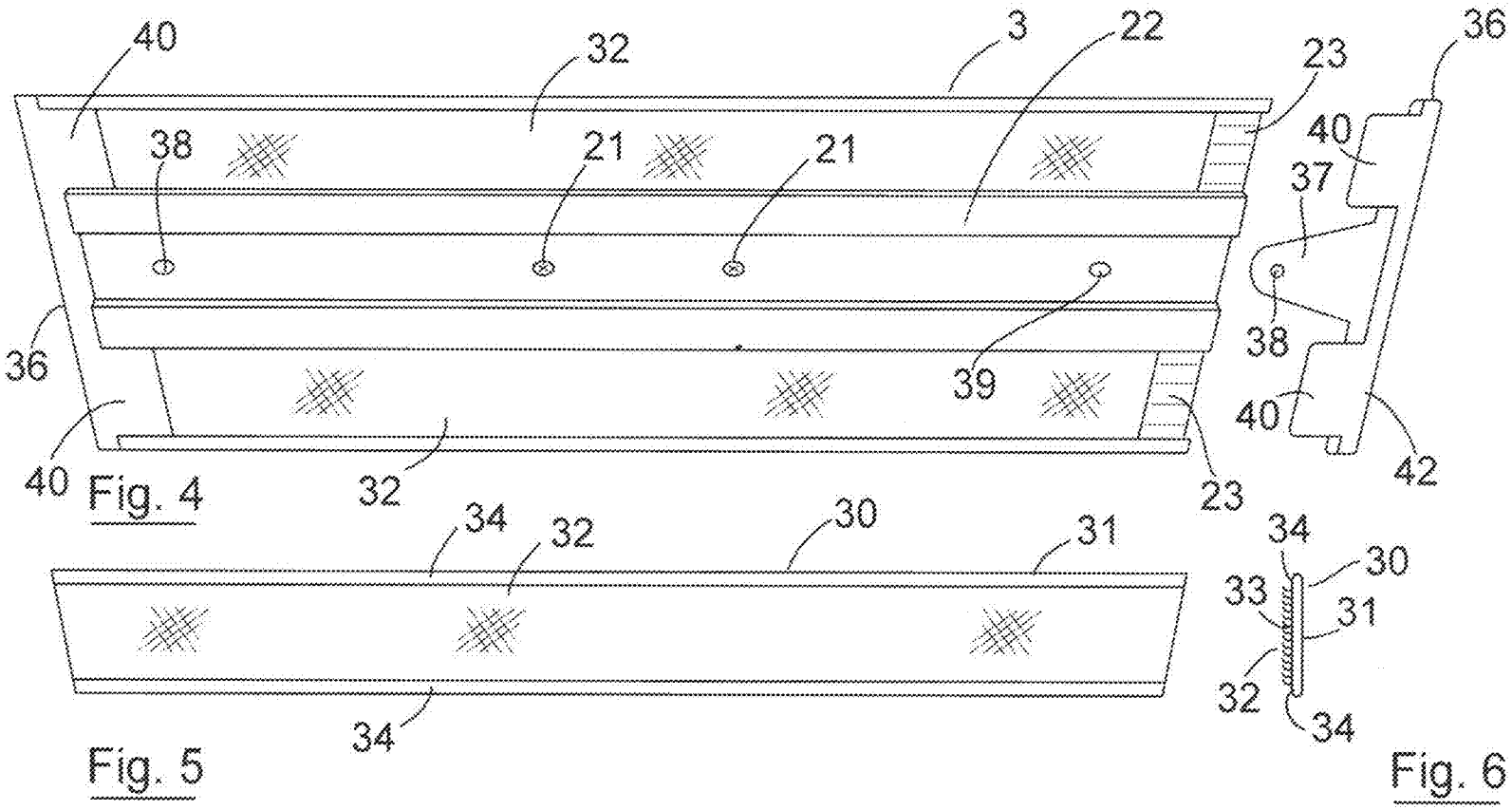
FIG. 4 is a partially exploded detail view showing an underside of a base plate of the floor cleaning mop apparatus.
FIG. 5 is a detail view showing a hook strip which is mounted on the base plate in use.
FIG. 6 is a detail end view of the hook strip shown in FIG. 5.
Figure 7:
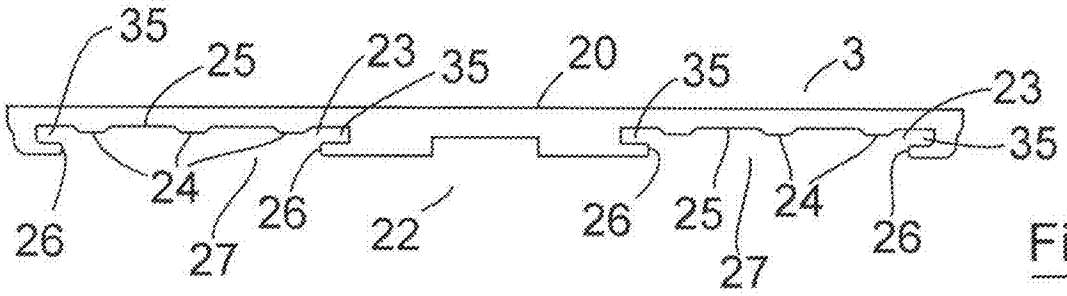
FIG. 7 is a detail end elevational view of the base plate.
Figure 9:
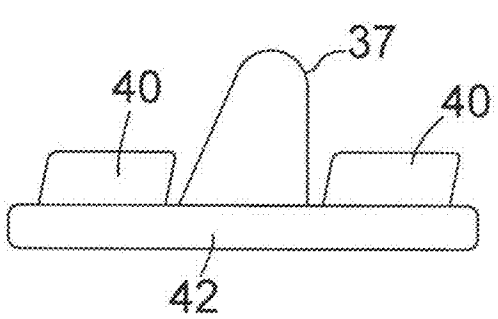
FIG. 9 is a detail rear elevational view of the end piece shown in FIG. 8.
Figure 8:
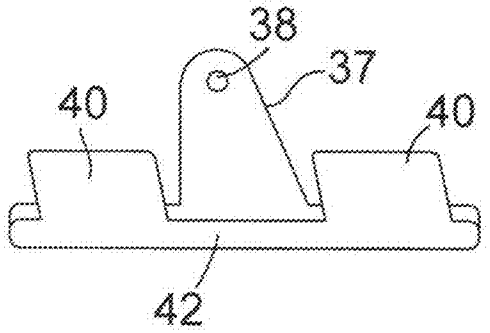
FIG. 8 is a detail front elevational view of an end piece forming portion of the base plate assembly.
Figure 10:
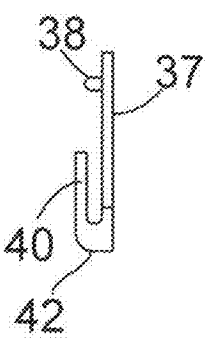
FIG. 10 is a detail side elevational view of the end piece.

The double-faced floor cleaning cloth 5 is made from microfibers comprising 80% polyester and 20% polyamide fibre in 2 denier and split into 16 micro segments in 0.1-0.13 denier by special chemical and textile treatment. The textured surface of the floor cleaning cloth 5 is shown in FIG. 3.

It will be noted that the floor cleaning cloth 5 has a width greater than the width of the base plate 3 and has side margins 9, 10 which project outwardly at each side of the base plate 3 when the base plate 3 is engaged with one of said engagement portions 6.

The base plate 3 is releasably engagable with a surface 7 of the floor cleaning cloth 5 by means of a hook and pile fastener arrangement. In this case hook elements are provided on a bottom face of the base plate 3 which grab onto the textured pile of the surface 7 of the floor cleaning cloth 5. When changing the base plate 3 between different engagement portions 6 on the upper face 7 of the floor cleaning cloth 5, the user can simply stand on the side margins 9, 10 of the floor cleaning cloth 5 and lift the base plate 3 out of engagement with the surface 7 of the floor cleaning cloth 5 and subsequently re-apply the base plate 3 into engagement with the next engagement portion on the surface 7 of the floor cleaning cloth 5.

The handle 2 is pivotally connected to the base plate 3 by the pivot connector 4 for pivoting about an axis which is coincident with, or substantially parallel to a longitudinal axis X of the base plate 3. The pivot connector 4 may be a universal connector to allow lateral pivoting of the handle 2 also.

The handle 2 may conveniently be made of aluminium or stainless steel tubing and is telescopic for length adjustment having a lower inner element 14 and an upper outer sleeve element 15 which slidably receives the lower inner element 14. A conventional twist-lock/release mechanism 18 is provided between the two elements 14, 15 for locking them together in the desired locations. An upper hand grip 16 is provided at the top of the outer sleeve element 15.

The base plate 3 assembly is shown in more detail in FIGS. 4 to 10. The base plate 3 may conveniently be formed by an aluminium extrusion. The hinged connector 4 is attached to a top face 20 of the base plate 3 and is secured thereto by screws 21 extending through the base plate 3 from an underside 22 of the base plate 3.

A pair of spaced-apart parallel elongate re-entrant slots 23 are formed on the underside 22 of the base plate 3. Each slot 23 has longitudinal ribs 24 projecting outwardly from an inner wall 25 of the slot 23. In-turned lips 26 at each side of the slot 23 spaced apart outwardly from the inner wall 25 define an opening or mouth 27 of the slot 23.

A hook strip 30 is slidably engagable within each slot 23. Each hook strip 30 comprises a panel 31 having a mat 32 of hook elements 33 projecting outwardly from the panel 31 with a border 34 at each side of the panel 31 outside the mat 32. These borders 34 engage in recesses 35 behind the in-turned lips 26 of the slot 23 to retain the panel 31 within the slot 23 with the hook elements 33 projecting outwardly through the mouth 27 of the slot 23 proud of the lips 26 for engaging with the cleaning cloth 5 in the manner of a hook and pile fastener.

End pieces 36 fitted at each end of the base plate 3 retain the hook strips 30 within the associated slots 23 on the underside 22 of the base plate 3. Each end piece 36 snaps into engagement with the base plate 3.

A tongue 37 of the end piece 36 engages the top face 20 of the base plate 3 and has a lug 38 which engages a through-hole 39 on the base plate 3 to releasably secure the end piece 36 on the base plate 3. A pair of spaced-apart flanges 40 on the end piece 36 are slidably engagable within the slots 23 on the underside 22 of the base plate 3 to retain and prevent any lateral movement of the hook strips 30. The tongue 37 and flanges 40 project outwardly from an end wall 42 of the end piece 36 which engages the end of the base plate 3 which is received between the tongue 37 and flanges 40. The tongue 37 is resiliently deformable to facilitate snap engagement of the lug 38 with the associated receiving hole 39 in the base plate 3.

Figure 2:
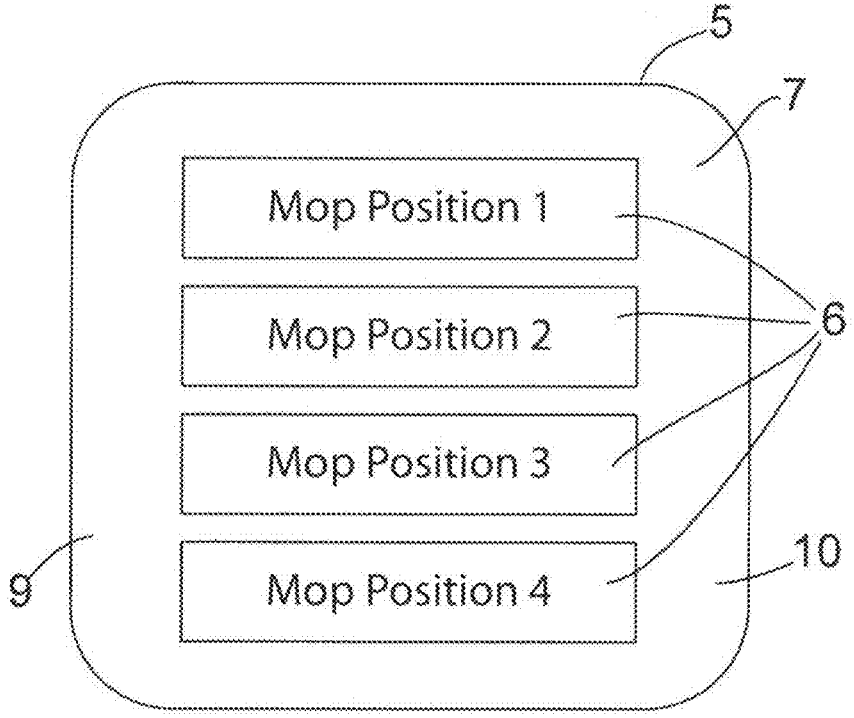
FIG. 2 is a detail plan view showing a floor cleaning cloth forming portion of the mop apparatus of the invention.

In use, the handle 2 can be adjusted to the required length by the user. The floor cleaning cloth 5 is dampened by the user and placed flat on the surface of the floor to be cleaned. The mats 32 of hook elements 33 on an underside of the base plate 3 are engaged with the first engagement portion 6 on the surface 7 of the floor cleaning cloth 5, in the manner of a hook and pile fastener, adjacent a leading edge of the floor cleaning cloth 5, as best seen in FIG. 2, and then the user proceeds to mop the floor. At suitable intervals as required the user will detach the base plate 3 from the surface 7 of the floor cleaning cloth 5 by standing on the side margins 9, 10 of the floor cleaning cloth 5 and lifting the base plate 3 away from the floor cleaning cloth 5, and then reattaching the base plate 3 to the next engagement portion 6 on the surface 7 of the floor cleaning cloth 5. When the cleaner has moved through the four engagement portions as shown in FIG. 2, the floor cleaning cloth 5 can be turned over and the procedure repeated again while cleaning the floor. Typically a number of the floor cleaning cloths 5 are provided and how many are used will obviously depend on the size of the floor area to be cleaned. After use, each of the floor cleaning cloths 5 can be laundered prior to re-use.

It will be appreciated that advantageously the split polyester and polyamide fibres in the floor cleaning cloth 5 afford a much superior cleaning capability than can be achieved by the use of cotton fibres. Further, as the fibres are so tiny they can get into surface pores and crevices for effective cleaning of hard floors. They are also abrasive which contributes to increasing the cleaning capability.

The floor cleaning cloth 5 is designed to grab any soils or residues on a hard floor. When the waffle weave floor cleaning cloth 5 hooks the soil, it will remain on the floor cleaning cloth 5 as it is moved across the floor. All soils and residues are permanently removed and as a consequence the residue films that cause the heavy soil problem with cotton mop heads can never build up. A conventional mop becomes saturated with the soils all over very quickly and as already stated, it can never hold the soils properly and thus essentially a dirty mop head is being used to clean the floor.

A benefit of the floor cleaning cloth 5 of the invention is that the position of the base plate 3 can be readily easily stepped up and down the floor cleaning cloth 5 on either side of the floor cleaning cloth 5 as previously described. As the floor is being cleaned only that portion of the floor cleaning cloth 5 underneath the base plate 3 becomes saturated with soils. By stepping down the floor cleaning cloth 5, the base plate 3 is moved to a fresh unsoiled area which hugely increases the cleaning capability.

Figure 11:
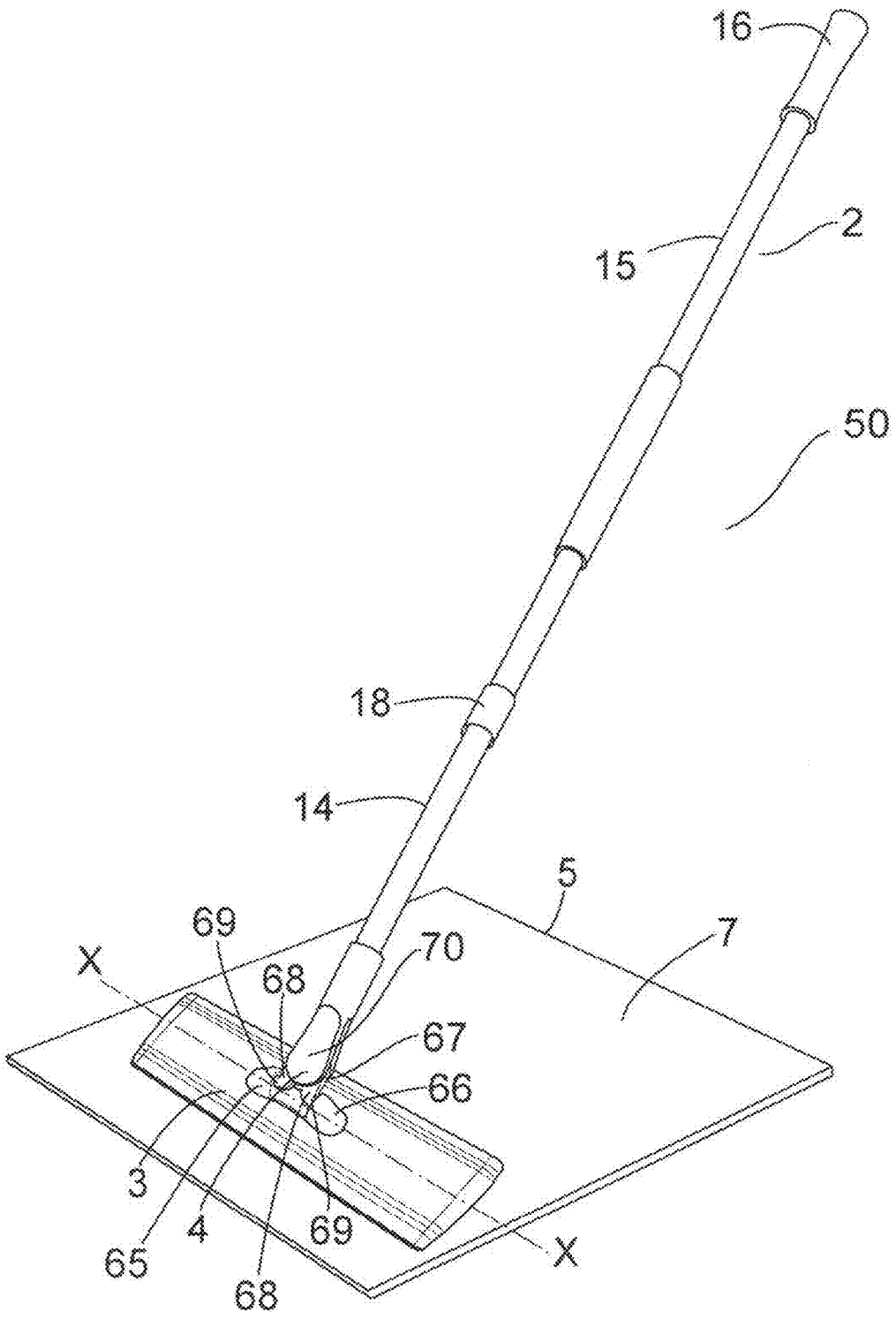
FIG. 11 is a perspective view of a floor cleaning mop apparatus according to a second embodiment of the invention.
Figure 12:
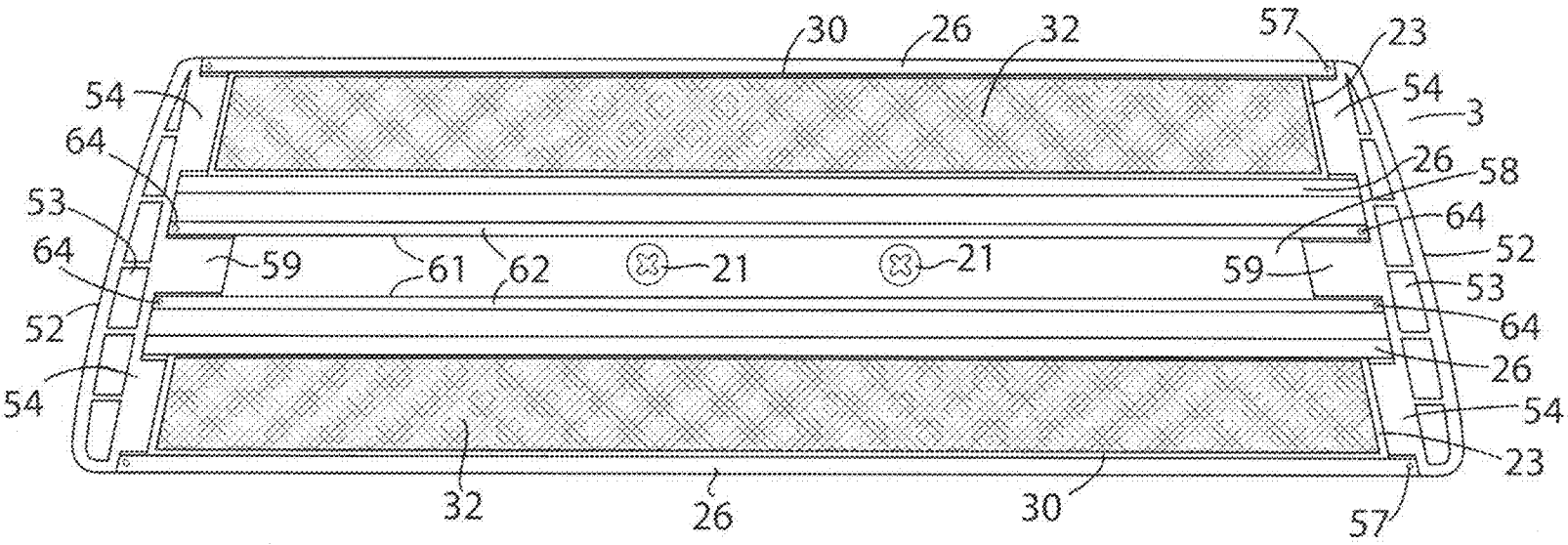
FIG. 12 is a detail view showing an underside of a base plate of the floor cleaning mop apparatus of FIG. 11.
Figure 13:
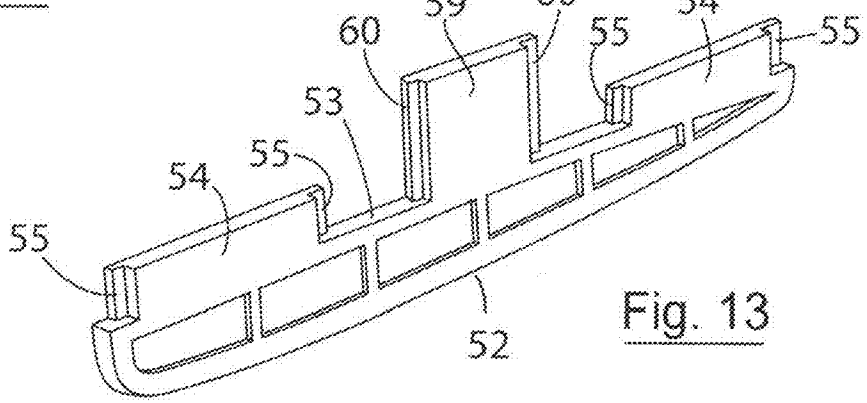
FIG. 13 is a detail perspective view of an end piece forming portion of the base plate assembly of FIG. 12.

Referring now to FIG. 11 to FIG. 13, there is illustrated another floor cleaning mop apparatus according to a second embodiment of the invention indicated generally by the reference numeral 50. Parts similar to those described previously are assigned the same reference numerals. In this case an alternative construction of base plate 3 and hinged connector 4 is provided. The base plate 3 has end pieces 52 which are fitted to each end of the base plate 3 to retain the hook strips 30 within the associated slots 23 on an underside of the base plate 3. Each end piece 52 has an end wall 53 which engages against an end of the base plate 3. A pair of spaced-apart hook strip retaining flanges 54 extend outwardly from the end wall 53 and engage within the slots 23 on the underside of the base plate 3 within which the hook strips 30 are mounted. Each hook strip retaining flange 54 has stepped edges 55 for complementary inter-engagement with a recess 35 and an associated inwardly directed lip 26 at each side of the slot 23. At least one of the lips 26 is crimped 57 into locking engagement with a stepped edge 55 of the flange 54.

A third re-entrant slot 58 (similar to the previously described slots 23) is provided on an underside of the base plate 3 parallel to and located between the slots 23 within which the hook strips 30 are mounted. Each end piece 52 has a lug 59 mounted between the flanges 54 and projecting outwardly from the end wall 53 for engagement within the third slot 58. This lug 59 has stepped sides 60 for complementary inter-engagement with a recess 61 and an associated inwardly directed lip 62 at each side of the third slot 58. At least one of the lips 62, and preferably both lips 62 are crimped 64 into locking engagement with a stepped side 60 of the lug 59.

Referring in particular to FIG. 11, the handle 2 is connected to the base plate 3 by a hinged connector 4 comprising a pair of spaced-apart pivot mounting blocks 65, 66 attached to an upper surface of the base plate 3. The mounting blocks 65, 66 are pivotally engaged by a hinge element having a U-shaped body 67 having a looped inner end with outwardly extending arms 68. Pivot pins 69 project laterally outwardly at free outer ends of the arms 68 to pivotally engage the mounting blocks 65, 66 for pivoting about a first axis X. A pivot pin at a lower end 70 of the handle 2 pivotally engages within the looped inner end of the hinge element body 67 for pivoting about a second axis which is perpendicular to the first axis X.

In the specification the terms "comprise, comprises, comprised and comprising" or any variation thereof and the terms "include, includes, included and including" or any variation thereof are considered to be totally interchangeable and they should all be afforded the widest possible interpretation and vice versa.

The invention is not limited to the embodiments hereinbefore described which may be varied in both construction and detail within the scope of the appended claims.

The invention claimed is:

1. A floor cleaning mop apparatus comprising:

an elongate handle, a base plate mounted at a lower end of the handle, a waffle weave microfiber double-faced floor cleaning cloth, the base plate being releasably engagable with at least two associated spaced-apart engagement portions on an upper surface of the floor cleaning cloth in use for moving the floor cleaning cloth across a floor surface, the floor cleaning cloth having a width greater than the width of the base plate and projecting outwardly at each side of the base plate when the base plate is engaged with one of said engagement portions, the base plate and the floor cleaning cloth being releasably engagable by means of a hook and pile fastener, the base plate having a pair of spaced-apart parallel elongate re-entrant slots on an underside of the base plate, a hook strip being mounted in each slot and having a mat of hook elements which projects outwardly through a mouth of the slot for engagement with the floor cleaning cloth, wherein end pieces are fitted to each end of the base plate to retain the hook strips within the associated slots, each end piece having an end wall which engages against an end of the base plate, and a pair of spaced-apart hook strip retaining flanges extending outwardly from the end wall and engaging within the slots on the underside of the base plate within which the hook strips are mounted, each hook strip retaining flange having stepped edges for complementary inter-engagement with a recess and an associated inwardly directed lip at each side of the slot, at least one of said lips being crimped into locking engagement with a stepped edge of the flange.

2. The floor cleaning mop apparatus as claimed in claim 1 wherein the floor cleaning cloth has four spaced-apart engagement portions.

3. The floor cleaning mop apparatus as claimed in claim 1 wherein each hook strip has a panel carrying the mat of hook elements with a border at each side of the panel outside the mat, said panel being slidably engagable within the slot in the underside of the base plate with said borders engaging behind in-turned lips at a mouth of the slot to retain the panel within the slot.

4. The floor cleaning mop apparatus as claimed in claim 1 wherein a third re-entrant slot is provided on an underside of the base plate parallel to and located between the slots within which the hook strips are mounted, and each end piece has a lug mounted between the flanges and projecting outwardly from the end wall for engagement within the third slot, said lug having stepped sides for complementary inter-engagement with a recess and an associated inwardly directed lip at each side of the third slot, at least one of said lips being crimped into locking engagement with a stepped side of the lug.

5. The floor cleaning mop apparatus as claimed in claim 1 wherein the microfiber of the floor cleaning cloth comprises a mixture of polyester and polyamide fibres.

6. The floor cleaning mop apparatus as claimed in claim 5 wherein the microfiber comprises 80% polyester and 20% polyamide fibre.

7. The floor cleaning mop apparatus as claimed in claim 1 wherein the handle is pivotally connected to the base plate for pivoting about an axis which is parallel to a longitudinal axis of the baseplate.

8. The floor cleaning mop apparatus as claimed in claim 7 wherein the handle is connected to the base plate by a hinged connector comprising a pair of spaced-apart pivot mounting blocks on the base plate, said mounting blocks engaged by a hinge element, said hinge element having a U-shaped body having a looped inner end with outwardly extending arms, pivot pins projecting laterally outwardly at outer free ends of the arms to pivotally engage the mounting blocks for pivoting about a first axis, a pivot pin at a lower end of the handle pivotally engaging within the looped inner end for pivoting about a second axis, said first axis and said second axis being mutually perpendicular.

9. The floor cleaning mop apparatus as claimed in claim 1 wherein the handle is telescopic.

10. A floor cleaning mop apparatus comprising:

an elongate handle, a base plate mounted at a lower end of the handle, a waffle weave microfiber double-faced floor cleaning cloth, the base plate being releasably engagable with at least two associated spaced-apart engagement portions on an upper surface of the floor cleaning cloth in use for moving the floor cleaning cloth across a floor surface, the floor cleaning cloth having a width greater than the width of the base plate and projecting outwardly at each side of the base plate when the base plate is engaged with one of said engagement portions, the base plate and the floor cleaning cloth being releasably engagable by means of a hook and pile fastener, the base plate having a pair of spaced-apart parallel elongate re-entrant slots on an underside of the base plate, a hook strip being mounted in each slot and having a mat of hook elements which projects outwardly through a mouth of the slot for engagement with the floor cleaning cloth, wherein end pieces are fitted at each end of the base plate to retain the hook strips within the associated slots, each end piece having an end wall which engages the end of the base plate, a tongue extending outwardly from the end wall engaging a top face of the base plate and having a lug which extends through an associated through hole in the base plate and a pair of spaced-apart hook strip retaining flanges extending outwardly from the end wall engaging within the slots on the underside of the base plate within which the hook strips are mounted.

11. The floor cleaning mop apparatus as claimed in claim 10 wherein the floor cleaning cloth has four spaced-apart engagement portions.

12. The floor cleaning mop apparatus as claimed in claim 10 wherein each hook strip has a panel carrying the mat of hook elements with a border at each side of the panel outside the mat, said panel being slidably engagable within the slot in the underside of the base plate with said borders engaging behind in-turned lips at a mouth of the slot to retain the panel within the slot.

13. The floor cleaning mop apparatus as claimed in claim 10 wherein the microfiber of the floor cleaning cloth comprises a mixture of polyester and polyamide fibres.

14. The floor cleaning mop apparatus as claimed in claim 13 wherein the microfiber comprises 80% polyester and 20% polyamide fibre.

15. The floor cleaning mop apparatus as claimed in claim 10 wherein the handle is pivotally connected to the base plate for pivoting about an axis which is parallel to a longitudinal axis of the baseplate.

16. The floor cleaning mop apparatus as claimed in claim 15 wherein the handle is connected to the base plate by a hinged connector comprising a pair of spaced-apart pivot mounting blocks on the base plate, said mounting blocks engaged by a hinge element, said hinge element having a U-shaped body having a looped inner end with outwardly extending arms, pivot pins projecting laterally outwardly at outer free ends of the arms to pivotally engage the mounting blocks for pivoting about a first axis, a pivot pin at a lower end of the handle pivotally engaging within the looped inner end for pivoting about a second axis, said first axis and said second axis being mutually perpendicular.

17. The floor cleaning mop apparatus as claimed in claim 10 wherein the handle is telescopic.

* * * * *